US009162195B2

(12) United States Patent
Haughton et al.

(10) Patent No.: US 9,162,195 B2
(45) Date of Patent: Oct. 20, 2015

(54) LINEAR MOTION MIXER

(71) Applicant: Enersave Fluid Mixers Inc., Oakville, Ontario (CA)

(72) Inventors: Gary Haughton, Oakville (CA); Alesandro Rosada, Toronto (CA)

(73) Assignee: Enersave Fluid Mixers Inc., Oakville, Ontario (CA)

( * ) Notice: Subject to any disclaimer, the term of this patent is extended or adjusted under 35 U.S.C. 154(b) by 0 days.

(21) Appl. No.: 14/390,879

(22) PCT Filed: Apr. 17, 2014

(86) PCT No.: PCT/IB2014/060818

§ 371 (c)(1),
(2) Date: Oct. 6, 2014

(87) PCT Pub. No.: WO2014/170871

PCT Pub. Date: Oct. 23, 2014

(65) Prior Publication Data

US 2015/0182927 A1 Jul. 2, 2015

Related U.S. Application Data

(60) Provisional application No. 61/813,745, filed on Apr. 19, 2013.

(51) Int. Cl.
*B01F 13/00* (2006.01)
*B01F 11/00* (2006.01)

(52) U.S. Cl.
CPC ..... *B01F 13/00* (2013.01); *B01F 11/0082* (2013.01); *B01F 11/0097* (2013.01)

(58) Field of Classification Search
CPC ..... B01F 15/00467; B01F 13/00
USPC ..... 366/256, 258, 332
See application file for complete search history.

(56) References Cited

U.S. PATENT DOCUMENTS 290,799 A * 12/1883 Perry ..... B01F 11/0082 185/40 F
867,179 A * 9/1907 Williams ..... F04B 9/02 366/332
923,644 A * 6/1909 Griggs ..... F16H 21/36 366/256

(Continued)

FOREIGN PATENT DOCUMENTS

CA 2563967 C 10/2002
WO WO 2004/098762 A1 11/2004

*Primary Examiner* — David Sorkin
*Assistant Examiner* — Abbas Rashid
(74) *Attorney, Agent, or Firm* — Patrick J. Hofbauer

(57) ABSTRACT

A linear motion mixer having a reciprocating drive assembly of the Scotch yoke type, wherein the yoke assembly is mounted on first and second column bearing shafts (i.e., Thomson shafts) by two or more contoured bearing shaft rollers. The way shafts of the yoke assembly are preferably mounted for rotation about their longitudinal axis so as to accommodate misalignment of the roller wheel of the crank assembly which drivingly interacts therewith. A cylinder rod end alignment coupler is preferably interconnected between the yoke assembly and the downstream components of the drive assembly to substantially prevent unbalanced tortional and shear forces from being transmitted into the yoke assembly from the mixing shaft. These and other improvements are disclosed, all of which reduce production costs, lost energy, excessive wear and binding or racking of a reciprocating drive assembly incorporating same.

15 Claims, 8 Drawing Sheets

(56) References Cited

U.S. PATENT DOCUMENTS

| | | | | | |
|---|---|---|---|---|---|
| 931,583 | A * | 8/1909 | Dudley | B01F 11/0082 | 366/256 |
| 945,639 | A * | 1/1910 | Taylor | F16H 21/36 | 366/332 |
| 4,289,040 | A * | 9/1981 | Haluko, Jr. | F16H 25/02 | 74/50 |
| 4,590,812 | A * | 5/1986 | Brackett | F16H 21/28 | 123/197.1 |
| 7,685,896 | B2 * | 3/2010 | Haughton | B01F 11/0082 | 366/258 |
| 2003/0198129 | A1 * | 10/2003 | Haughton | B01F 11/0082 | 366/332 |
| 2005/0174883 | A1 * | 8/2005 | Haughton | B01F 11/0082 | 366/332 |
| 2006/0221766 | A1 * | 10/2006 | Haughton | B01F 11/0082 | 366/332 |
| 2008/0219091 | A1 * | 9/2008 | Haughton | B01F 11/0082 | 366/333 |

* cited by examiner

LINEAR MOTION MIXER

FIELD OF THE INVENTION

The present invention relates to linear motion mixers for mixing fluids, and more particularly to improvements in the reciprocating drive assemblys used for such mixers.

BACKGROUND AND SUMMARY OF THE INVENTION

The inventor herein is a pioneer in the use of linear motion mixers for the mixing of fluids in large scale vessels to carry out industrial and commercial processes on a substantially continuous basis. Examples of such continuous processes include, in the mining field, froth separation and solvent extraction electrowinning, and, in the waste water treatment field, the bacterial digestion of sewage sludge in municipal waste water digesters. While not limited to use in these large scale mixing operations, the improved mixing characteristics, operational energy savings, and diminished maintenance costs achieved by substituting a single linear motion mixer for a plurality of prior art rotary style mixers in these large scale operations are more significant and self-evident.

Prior art linear motion mixers of the present inventor are disclosed in, inter alia, WO 02/083280 A1, WO 2004/045753 A1 and WO 2004/098762 A1, all of which references are hereby incorporated by reference. The reciprocating drive assemblies commonly disclosed in all of these prior art references are so-called "Scotch yoke mechanisms", wherein a crank assembly on a rotating flywheel reciprocates in a horizontal race of the yoke assembly, thereby causing the yoke member to slide up and down relative to one or more vertically oriented linear track slides/guide rails. A vertically directed mixing shaft having a mixing head rigidly attached adjacent its bottom end is connected adjacent its top end to the yoke member by means of a shaft mounting assembly, thereby to impart reciprocating motion of the yoke member to the driveshaft upon rotation of the flywheel.

While the aforesaid International Patent Applications demonstrate, disclose and teach the advantages of using a Scotch yoke drive assembly for converting rotary motion of a flywheel into reciprocating motion of a mixing shaft and attached mixing head, the inventor has, as a first adaptor of this technology to linear motion mixers, become aware of the need for further improvements in this technology to simplify and reduce the costs of its production and on-site installation, to improve its operating reliability, and to improve its maintenance efficiencies.

To this end, it is an object of the present invention to provide an improved reciprocating drive assembly for linear motion mixers which exhibits significantly reduced manufacturing costs and complexity by reducing the need for complex parts machined to close tolerances.

It is a further object of the present invention to provide an improved reciprocating drive assembly for use in a linear motion mixer, which drive assembly is easier to install, to assemble, and to maintain in the field due to the use of assemblies having much wider manufacturing and assembly tolerances than previously available for use in prior art Scotch yoke mechanisms suitable for this purpose.

It is a further object of the present invention to provide an improved reciprocating drive assembly for linear motion mixers which reduces energy consumption by reducing frictional losses inherent in prior art Scotch yoke mechanisms used for this purpose.

It is still a further object of the present invention to provide an improved reciprocating drive assembly for linear motion mixers which significantly reduces maintenance requirements by not requiring continuous lubrication for reliable and energy efficient operation.

It is yet a further object of the present invention to provide an improved reciprocating drive assembly for linear motion mixers which is less susceptible to energy loss and maintenance issues caused by binding and/or jamming between the linear bearing slides and the yoke assembly due to unbalanced lateral loading of the yoke assembly by the mixing shaft as the yoke assembly reciprocates along the linear bearing slides.

There is thus disclosed according to one aspect of the present invention a linear motion mixer for mixing fluids within a vessel, the mixer being of the type having a mixing shaft with an upper and a lower end and defining a longitudinal axis extending therebetween. The mixing shaft supports a mixing head adjacent its lower end for immersion in the fluids to be mixed. An improved reciprocating drive assembly is connectable to the mixing shaft adjacent its upper end for imparting reciprocating movement to the mixing head parallel to the longitudinal axis. The improved drive assembly comprises: a flywheel mounted for rotation about a rotational axis extending substantially normal to the longitudinal axis; a crank assembly projecting from the flywheel in a direction substantially parallel to the rotational axis; first and second column bearing shafts each extending substantially parallel to the longitudinal axis in laterally spaced relation from each other so as to define a pair of guide axes substantially parallel to the longitudinal axis; a yoke assembly positioned between the first and second column bearing shafts, which assembly has two or more contoured bearing shaft rollers mounted thereon for respective rolling contact with each of the first and second column bearing shafts. This arrangement provides for rolling movement of the yoke assembly along the column bearing shafts in substantially parallel relation to the two guide axes.

The yoke assembly further comprises a linear race defined between a lower surface of an upper way shaft and an upper surface of a lower way shaft arranged in opposed relation to each other for operative contact by the crank assembly. The race is disposed within the yoke assembly, with each said upper and lower surface being oriented substantially normal to both the rotational axis and the longitudinal axis. The mixing shaft is connected to the yoke assembly adjacent its upper end for movement with the yoke assembly.

With this arrangement, when the flywheel is rotated, the crank assembly is caused to linearly translate back and forth within the race, thereby urging the yoke assembly to reciprocatingly roll along the first and second column bearing shafts to impart said reciprocating movement to the mixing head. According to one embodiment of the invention, the reciprocating drive assembly has four contoured bearing shaft rollers operatively mounted, two each adjacent opposed sides of the yoke assembly, for rolling contact with a respective one of the first and second column bearing shafts.

Each of the contoured bearing shaft rollers are preferably mounted for rotation on the yoke assembly using a zero maintenance angular contact ball bearing assembly.

According to another aspect of the present invention, at least one of, and preferably both of, the way shafts are mounted on the yoke assembly to rotate about their respective axis of symmetry in response to operative contact by the crank assembly. Preferably, but not essentially, both the upper and lower surfaces of the way shafts are formed from a heat hardened steel alloy material.

According to yet another aspect of the present invention, a roller wheel is rotatably mounted on the crank assembly for rolling contact with the upper and lower way surfaces to affect the aforesaid operative contact therewith by the crank assembly. This roller wheel preferably has a hardened steel outer surface for rolling contact with said upper and lower way surfaces, and is still more preferably, is rotatably mounted on the crank assembly by means of a low friction, heavy duty bearing hub. To reduce costs, lessen maintenance, and to increase durability, this bearing hub is most preferably a commercially available truck bearing hub.

According to yet another aspect of the present invention, to mitigate against misalignment of the mixing shaft and resulting unbalanced lateral loading of the yoke assembly by the mixing shaft as the yoke assembly reciprocates along the linear bearing slides, the mixing shaft is preferably, connected to the yoke assembly through a cylinder rod end alignment coupler interposed between the yoke assembly and the upper end of the shaft.

According to still another aspect of the present invention, the longitudinal axis, the pair of guide axes, and the axis of symmetry of the upper and lower way shafts are all preferably, but not essentially, positioned in a substantially common vertical plane with one another. This arrangement reduces the bending loads that might otherwise arise from misalignment of these components, were they were positioned in different vertical planes. As a consequence, any resulting wear is significantly minimized, which increases the mechanical efficiency and longevity of the reciprocating drive assembly.

The above and other objects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

Figure 1:
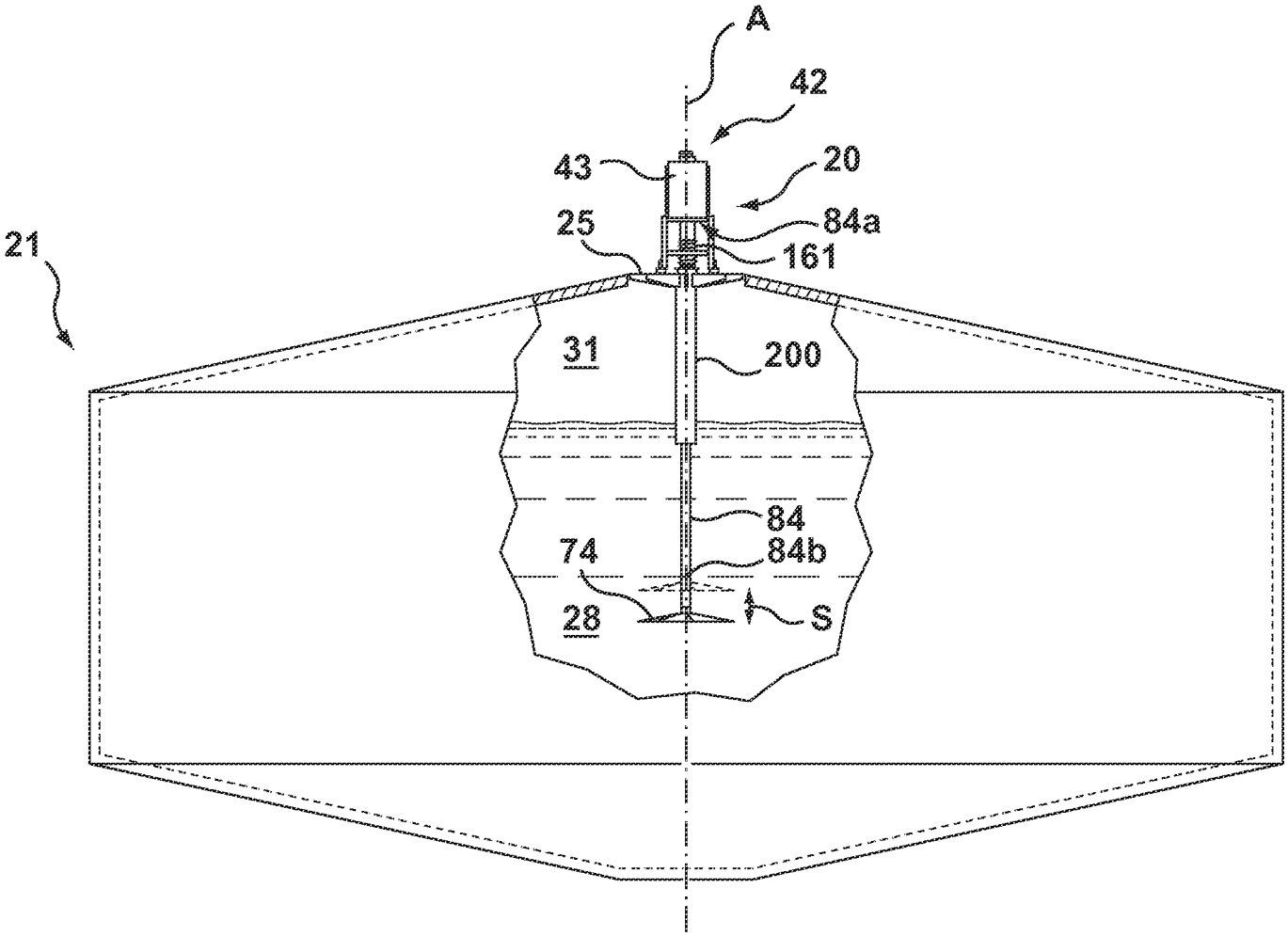
FIG. 1 is a front elevational view of an improved linear motion mixer according to the present invention shown installed atop a vessel (in this case a municipal sewage digester, shown partially cut away), for mixing fluids within the vessel.

With particular reference to FIG. 1, there will be seen a linear motion mixer 20 shown installed atop a vessel 21 (in this case a municipal sewage digester, shown partially cut away), for mixing fluids 28 within the vessel 21. Any other type of vessel, either opened or closed at its top end, may be used with the mixer 20.

The linear motion mixer 20 comprises a mixing shaft 84 having an upper end 84*a* and a lower end 84*b* which mixing shaft 84 defines a longitudinal axis "A" extending therebetween. The mixing shaft 84 supports a mixing head 74 adjacent its lower end 84*b* for immersion in the fluids 28 to be mixed. The mixing shaft 84 may, for purposes described in, for example, WO 2004/098762 A1, be encircled about its upper end 84 by a draught tube 200 which extends downwardly from a base plate 25 situated atop the vessel 24, but such encirclement is entirely optional, depending upon the specific mixer application.

A reciprocating drive assembly, designated by the general reference number 42, is connectable to the mixing shaft 84, preferably but not essentially, in a releasable manner by means of a rod eye coupling 35, having a closed loop at it upper end, which rod eye coupling 35 is mounted on the reciprocating drive assembly 42 for movement therewith, and a removable clevis pin 36 passing though the lower body portion of the rod eye coupling 35 and the upper end 84*a* of the mixing shaft 84.

Figure 2:
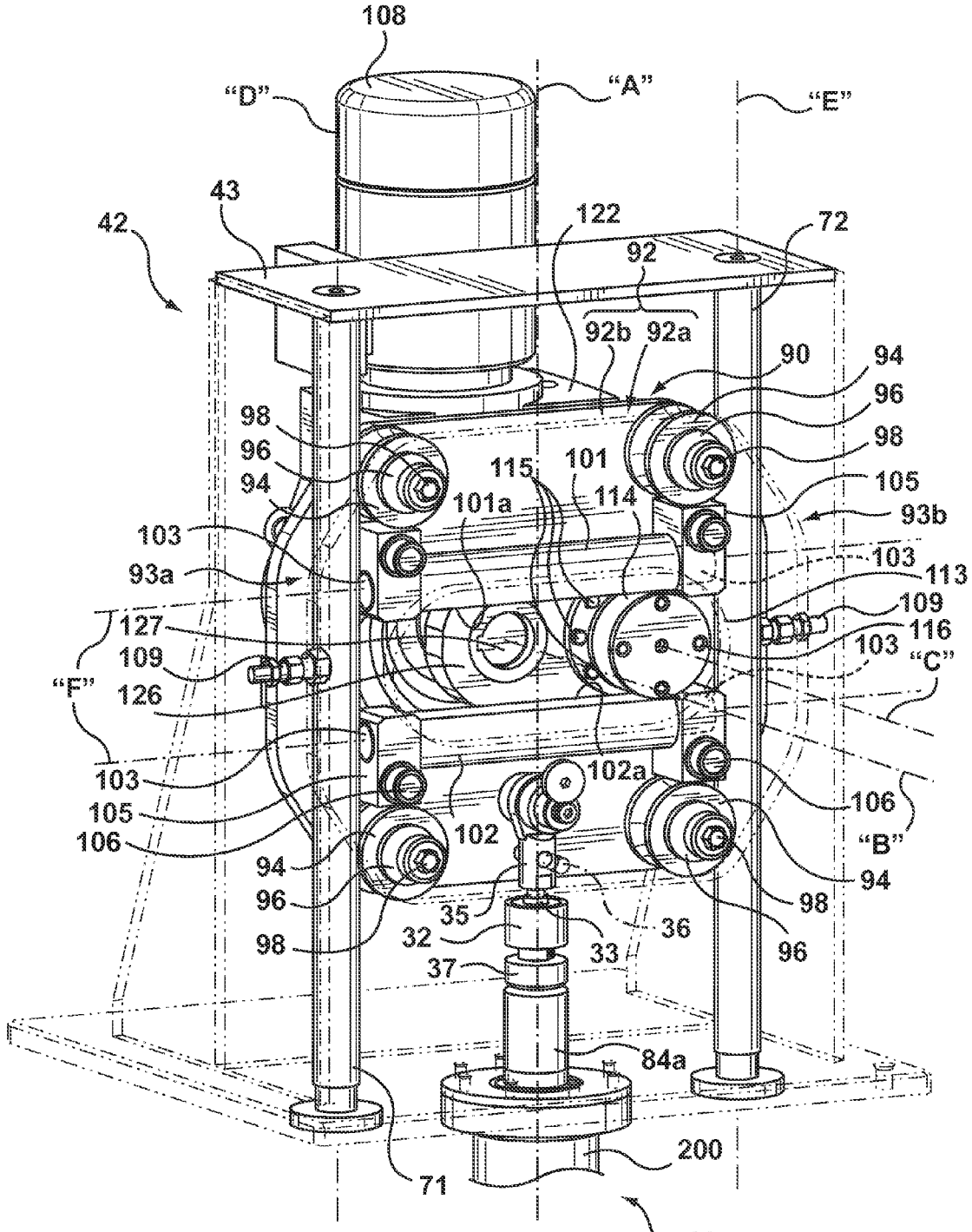
FIG. 2 is a front isometric view on a large scale and in isolation, of the reciprocating drive assembly of the linear motion mixer shown in FIG. 1, partly in phantom outline, to facilitate illustration.
Figure 3:
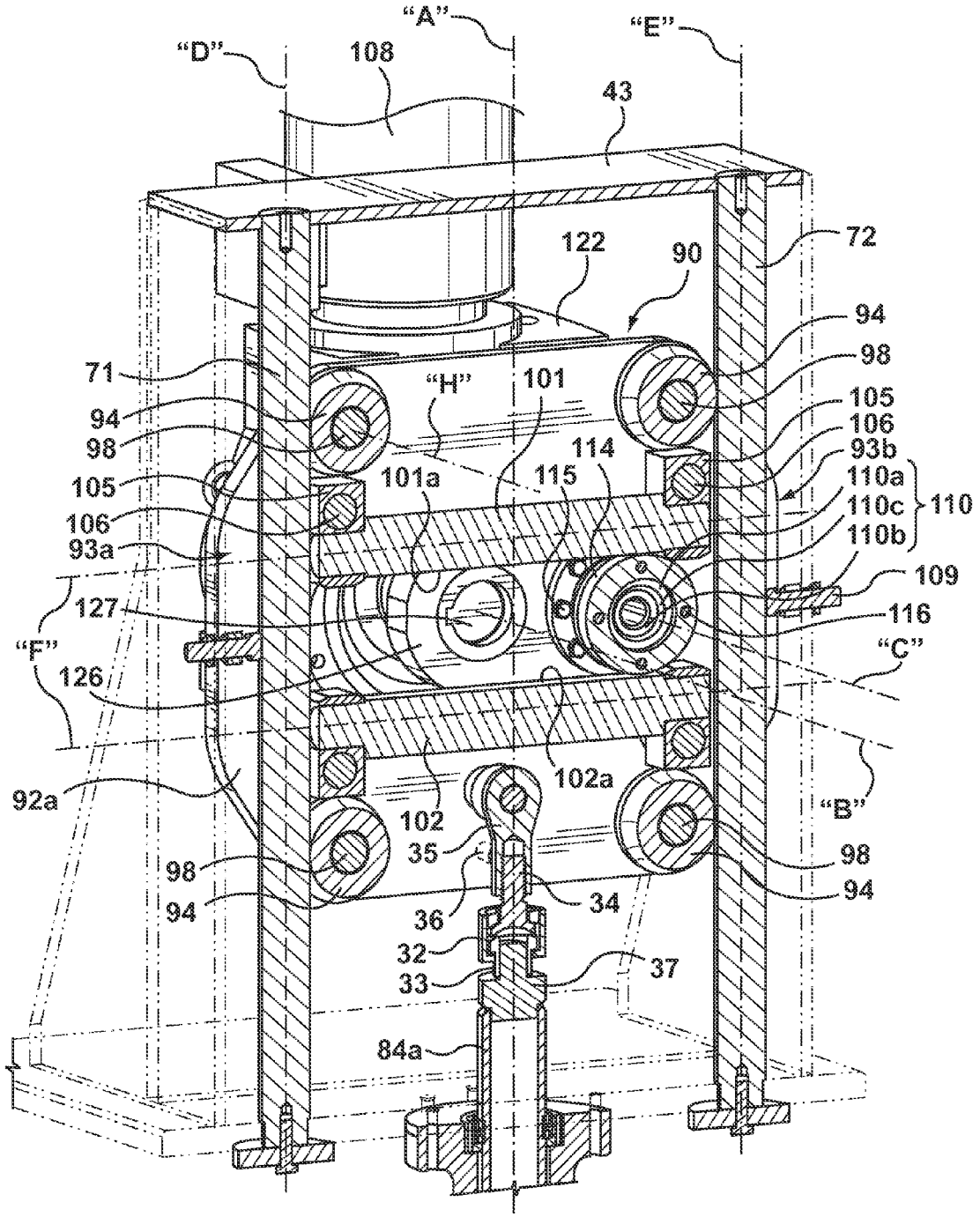
FIG. 3 is a front sectional view of the embodiment of FIG. 2.
Figure 4:
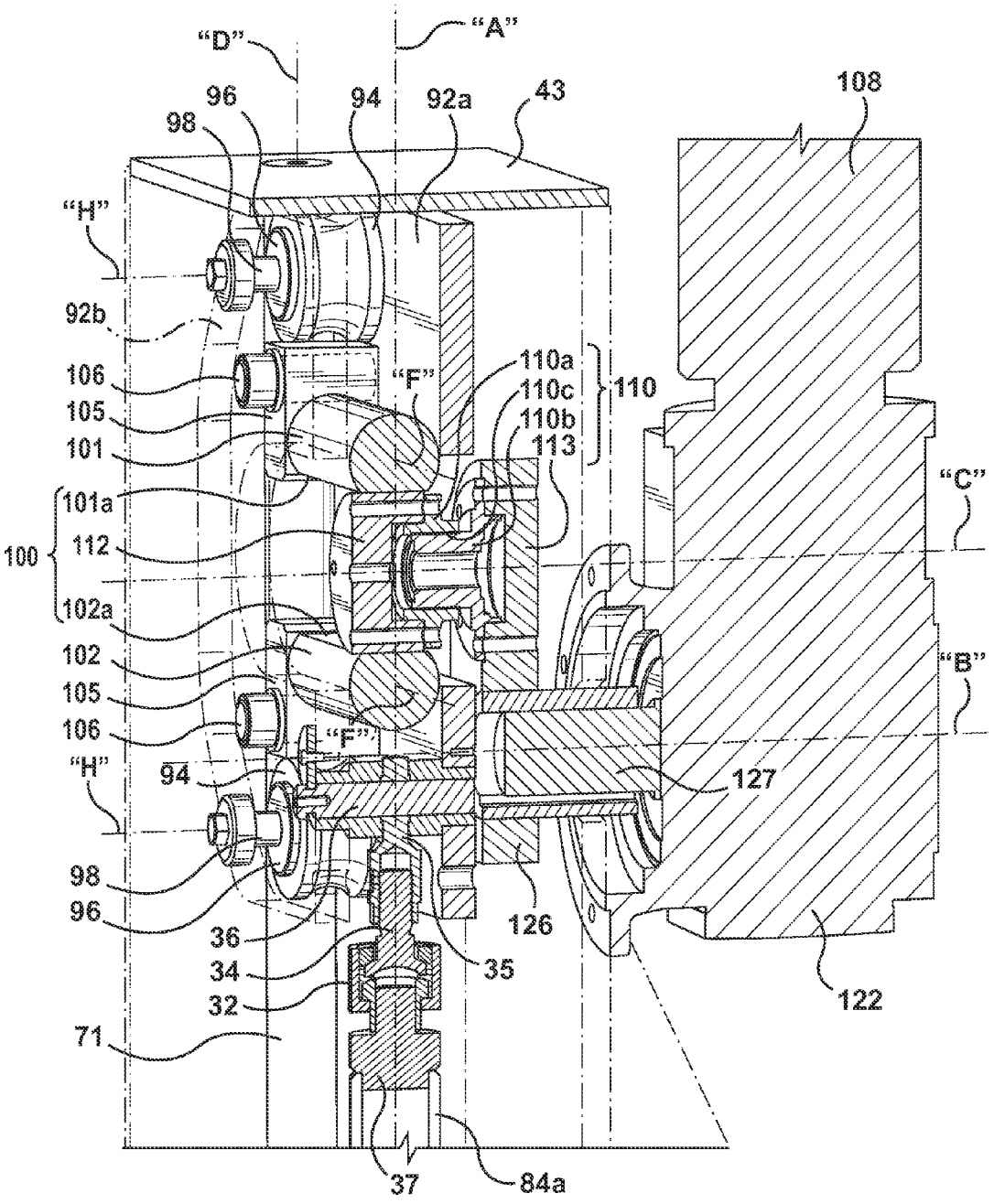
FIG. 4 is a medial sectional view of an upper portion of the embodiment of FIG. 2.
Figure 6:
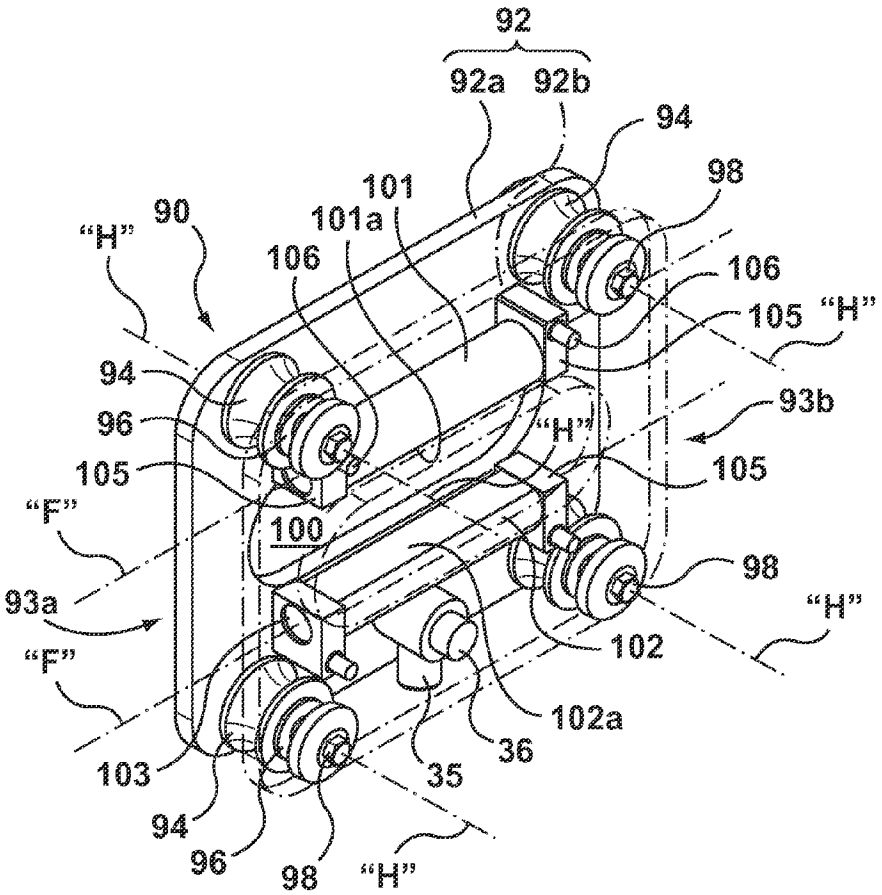
FIG. 6 is an enlarged scale isometric view, in isolation, of the yoke assembly of FIG. 5.
Figure 5:
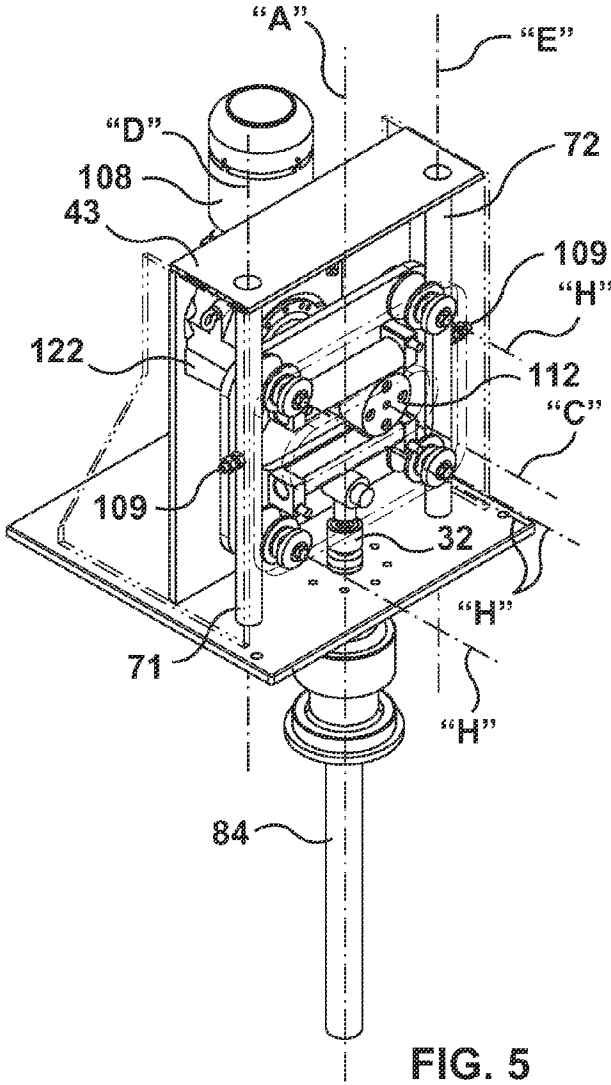
FIG. 5 is a top, side isometric view, partly in phantom outline, of the embodiment of FIG. 2.

As shown in FIGS. 2-4, and as an improvement to prior art linear motion mixers, it is preferable that the clevis pin 36 pass through the lower body portion of the rod eye coupling 35 and the upper end 34 of a cylinder rod end alignment coupler 32 (hereinafter, "CREAC"), which CREAC is attached at its lower end to the upper end 84*a* of the mixing shaft 84. The CREAC 32 preferably has its lower end 33 held fast by a swage plug 37 inserted into and held fast by the upper end 84*a* of the mixing shaft 84. With such an arrangement, the lower end 33 of the CREAC is free to rotate about axis "A" relative to its upper end 34, with the result that any tortional loading of the lower end 34 of the CREAC that may be caused by reciprocation of the mixing head along axis "A" through the fluid 28 during operation of the linear motion mixer 20 is not transmitted to the upper end 84*a* of the CREAC, and hence on to the upstream components of the reciprocating drive assembly 42 of the linear motion mixer 20, with potential damaging effects to such upstream components.

Figure 8:
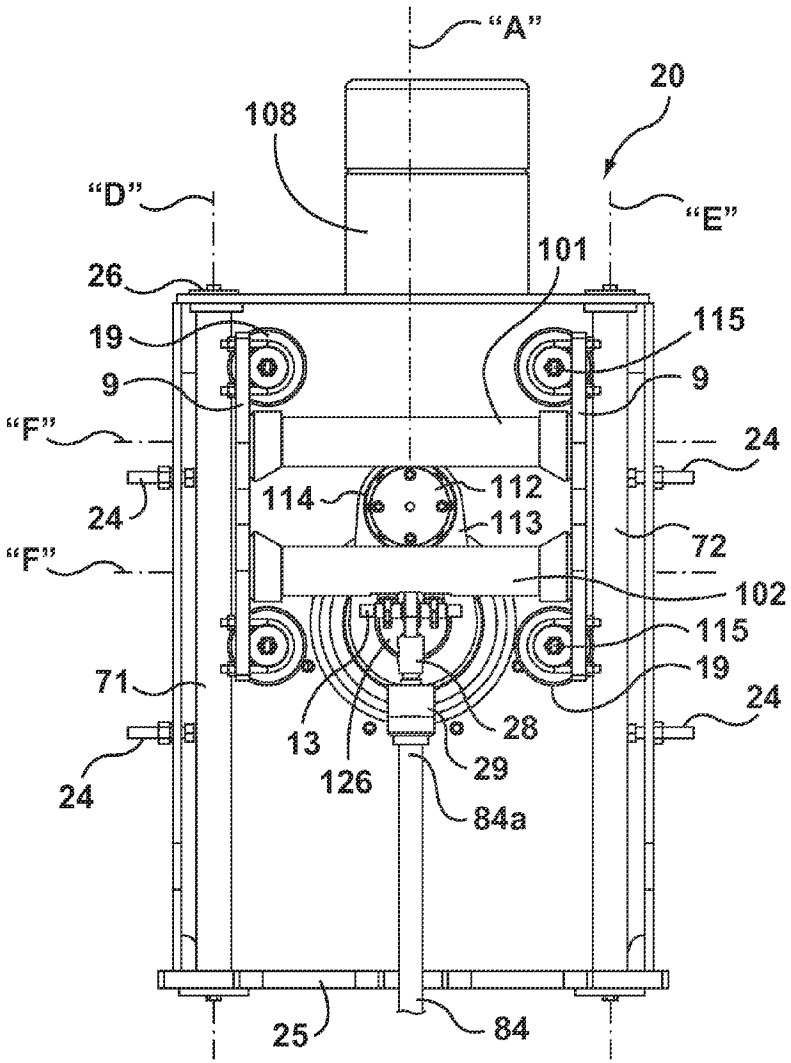
FIG. 8 is a front elevational view of the embodiment of FIG. 7.
Figure 7:
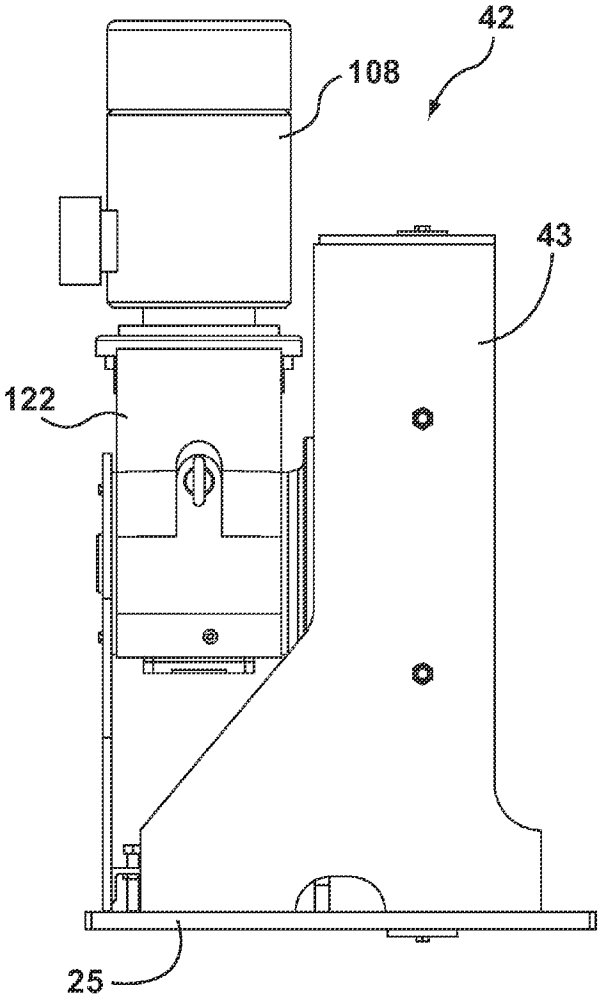
FIG. 7 is a side elevational view of a second embodiment of reciprocating drive assembly according to the present invention.

The CREAC is best seen in section just below the clevis bracket 35 in FIGS. 2-4. A suitable form of CREAC is available from Magnaloy Coupling Company, a division of Douville Johnston Corporation, of Alpina, Mich., USA. Model M Series accommodates, in addition to the rotational freedom mentioned in the previous paragraph, 10 degrees of spherical misalignment and ⅛ inch of lateral misalignment of the mixing shaft 84; Model R Series accommodates 7.5 degrees of spherical misalignment and ⅛ inch of lateral misalignment. The CREAC shown in FIG. 8 as Item 29 is a Magnaloy™ MO50-12412 cylinder rod end alignment coupler. The insertion of a CREAC into the driveline of the linear motion mixer 20 at the connective junction between the reciprocating drive assembly 42 and the upper end of the mixing head shaft 84, as shown in both embodiments of the present invention disclosed herein, represents a significant improvement over the prior art, as it permits much more even loading of the yoke assembly reciprocating drive assembly 42 during reciprocation of the mixing head 74, resulting in increased operational tolerances and longer service life. Such misalignment of the mixing shaft 84 is particularly troublesome in the common situation where the mixing shaft/mixing head 74 subassembly is manufactured by a different party than the party who manufactures the reciprocating drive assembly 42, or where this subassembly is installed by a contractor without due motivation or care to assure precise alignment of these components with the longitudinal axis "A", or where such misalignment is caused by mishandling during shipping or assembly of the linear motion mixer.

The reciprocating drive assembly 42 is preferably a so-called "scotch yoke" mechanism mounted in a housing 43, which housing may be a substantially open frame as shown in FIGS. 2-7 for ease of illustration, or, more normally, fully enclosed to protect the reciprocating drive assembly 42 from the elements and from vandalism, with a fully enclosed housing 43 being shown in FIG. 1, only. The two terms "scotch yoke mechanism" and "reciprocating drive assembly" are used interchangeably in this specification and in the appended claims. The scotch yoke mechanism 42 described is structurally and functionally similar to that described in WO 2004/098762 A1, although significant refinements and improvements thereover are incorporated into the improved embodiments disclosed and claimed herein. With the reciprocating drive assembly 42 connected to the mixing shaft 84 adjacent its upper end 84*a* as aforesaid, the drive assembly 42 is able to impart its reciprocating movement to the mixing shaft 84 and the mixing head 74 attached thereto in substantially parallel relation to the longitudinal axis "A" along a stroke length depicted by double-headed arrow "s" in FIG. 1 (with the mixing head 74 being shown in solid outline at the bottom of its stroke length, and in phantom outline at the top of its stroke length).

The scotch yoke mechanism 42 illustrated in FIGS. 1-6 comprises a flywheel 126 mounted for rotation on the keyed output shaft 127 of a gear reduction unit 122 about a rotational axis "B", which rotational axis "B" extends substantially normal to the longitudinal axis "A". The keyed output shaft 127 is conventionally rotationally driven through the gear reduction unit 122 by a drive motor 108, being, for example, an electric drive motor rated for between about 4 and 20 horsepower, and is preferably mounted atop the gear reduction unit 122 behind the housing 43.

A crank assembly 110 is mounted on and projects from the flywheel 126 in a direction substantially parallel to the rotational axis "B" so as to define an axis "C" as seen in FIGS. 2 and 4. The crank assembly 110 preferably comprises a crank arm 113 (which may be integral with the flywheel 126, as shown in the Figures, or may be a separate member operatively connected to the flywheel 126 to be driven upon rotation of the flywheel, which latter arrangement is illustrated in, for example, WO 02/083280 A1, WO 2004/045753 A1 and WO 2004/098762), a low friction, heavy duty bearing hub 110, and more preferably an automotive wheel bearing hub 110, and most preferably a commercially available truck wheel bearing hub 110 comprising, as best seen in FIG. 4, an inner axle stub portion 110*b* affixed by bolts 115 to the crank arm 113, and an outer hub portion 110*a* mounted by means of heavy duty automotive wheel bearings 110*c* for rotation about the axle stub portion 110*b*. A suitably low friction, heavy duty commercially available truck wheel bearing hub found useful for this application by the applicant is a front end wheel bearing hub for a Chevrolet 2500 Series 4×4 truck, available from Chevrolet dealers across North America, and from Parts Source Stores throughout Canada, under MOOG steering and suspension Part #013-0513-0. Other heavy duty automotive wheel bearing hubs can be substituted for the model disclosed in order to meet the dynamic loads expected in the specific mixing application at hand. The wheel bearing hub 110 is preferably pre-packed with heavy service lubricant to reduce maintenance and to extend hub bearing 110*c* service life. Use of pre-existing automotive wheel bearing hubs 110 is very advantageous and cost effective, as such hubs are extremely robust and easily fitted to the drive assembly 42, are readily available in the marketplace at reasonable cost, and their known performance specifications and loading characteristics reduce testing and development time for of new models of linear motion mixers.

A roller wheel 112 having at least a hardened steel outer circumference 114 is operatively mounted on the outer hub portion 110*a* of the automotive wheel bearing hub 110 by means of bolts 116 which removably fasten the roller wheel 112 to the outer hub portion 110*a* for rotation therewith about axis "C". The hardening of the steel outer circumference 114 may be by, for example, by heat treating.

First 71 and second 72 column bearing shafts are mounted in the housing 43 in laterally spaced relation from one another and so as to each extend in substantially parallel relation to the longitudinal axis "A" thereby to define a pair of guide axes "D" and "E" substantially parallel to the longitudinal axis "A". The column bearing shafts 71, 72 are preferably, but not essentially, formed from a high tensile strength steel alloy cylindrical bar stock, such as SAE 4340. After any machining operation, the column bearing shafts 71, 72 may be heat treated to a 39-41 Rockwell C through hardness.

The column bearing shafts 71, 72 are preferably mounted to the housing 43 adjacent their top and bottom ends so as to be substantially free of obstruction along their operative length, and are also preferably of substantially circular cross-section, as shown. This arrangement not only allows for more freedom of design for the drive assembly 42, but, allows for lower frictional losses in the reciprocating drive assembly 42 from typical prior art arrangements, as will become more apparent as this description proceed.

One or more shaft support bolts 109 are optionally mounted on the side of housing 43 in alignment with the guide axes "D" and "E" of the respective column bearing shafts 71, 72. These support bolts 109 are adjustable in length to variably bear upon the adjacent column bearing shaft 71, 72 so as to support it against lateral bending out of alignment with the respective guide axes "D" or "E". This allows truing alignment of the column bearing shafts 71, 72 with the aforesaid axes "D" and "E".

The reciprocating drive assembly 42 further comprises a yoke assembly 90 which is positioned between the first 71 and second 72 column bearing shafts to reciprocate back and forth relative to these bearing shafts in substantially parallel relation to the longitudinal axis "A", as described more fully hereinbelow.

While the yoke assembly has in the prior art been constructed with a yoke body having a unitary mono-block construction (as shown in WO 02/083280 A1, WO 2004/045753 A1 and WO 2004/098762), such construction requires extensive machining to close tolerances, which machining is not only difficult and expensive, but very unforgiving to eccentric loading (i.e., loading skewed to axis "A") introduced into the drive assembly 42 by the mixing shaft 84 in operation. In contrast, the body 92 of the yoke assembly 90 as disclosed in FIGS. 1-6 may be constructed from two flat plates 92*a*, 92*b* that are held in parallel spaced relationship from one another by four contoured bearing shaft rollers 94 operatively mounted, two each, adjacent opposed sides 93*a* and 93*b* of the yoke assembly 90 for rolling contact two each of said rollers 94 with a respective one of the first 71 and second 72 column bearing shafts.

The four contoured bearing shaft rollers 94 are each preferably mounted for rotation on the yoke assembly 90 about a central axis "H" by means of a hub member 96, which hub member incorporates one or more ball bearing assemblies to reducing rotational friction, and through which hub member 96 passes a central bolt 98, which bolt serves not only as an axle shaft about which the respective roller 94 may rotate, but also as a fastener to hold the various components of the yoke assembly 90 together in their assembled relationship as shown. The ball bearing assemblies within the hub member 96 are most preferably a zero maintenance angular contact ball bearing assembly. Moreover, the four contoured bearing shaft rollers 94 preferably each present a concave, circumferential outer surface profiled to minimize the area of rolling contact with the cylindrical outer surface of the first 71 and second 72 column bearing shafts on which they roll.

The bearing shafts 71, 72 are preferably manufactured from high tensile strength alloy steel, and are preferably heat treated for extra durability. Similarly, the bearing shaft rollers 94 are preferably formed from high tensile strength alloy steel, and at least the circumferential outer contact surface is also heat treated. All of these specifications are intended to reduce energy consumption of the linear motion mixer 20, to extend service intervals, and to extend the service life of the drive assembly 42 by minimizing rolling friction between the bearing shaft rollers 94 and the shafts 71, 72 upon reciprocation of the yoke assembly 90 relative to the shafts 71, 72. With this arrangement, the bearing shaft rollers 94 provide for rolling movement of the yoke assembly 90 along the column bearing shafts 71, 72 in substantially parallel relation to the guide axes "D" and "E" and to the longitudinal axis "A", as aforesaid.

As seen in FIGS. 2-6, the yoke assembly 90 further comprises a substantially horizontal linear race 100 defined between a lower surface 101*a* of an upper way shaft 101 and an upper surface 102*a* of a lower way shaft 102 arranged in opposed relation to each other for operative rolling contact with the hardened steel outer circumference 114 of the roller wheel 112 of the crank assembly 110. The race 100 is disposed within the yoke assembly 90 between the two plates 92*a*, 92*b*, so as to be in vertical alignment with an opening of elongated ovoid outline centrally positioned in each of the two flat plates 92*a*, 92*b*. Each of the upper 101*a* and lower 102*a* surfaces are positioned so as to be oriented substantially normal to both the rotational axis "B" and the longitudinal axis "A". Ideally, but not necessarily, both of the upper 102*a* and lower 101*a* surfaces are substantially planar, and are substantially parallel to one another.

In order to further improve the manufacturing and operational efficiencies and tolerances of the reciprocating drive assembly 42 of the present invention, thereby to lessen excessive or uneven wear and to lessen the chances of the drive assembly 42 jamming through, for example, uneven loading of the scotch yoke mechanism by reason of misalignment of the mixing shaft 84 with the longitudinal axis "A", or by uneven contact between the hardened outer circumference 114 of the roller wheel 112 and the upper 101*a* or lower 102*a* surfaces of the way shafts 101, 102, respectively, it is preferable to mount at least one of the upper 101 and lower 102 way shafts on the yoke assembly 100 so as to rotate about its respective axis of symmetry "F" in response to operative contact by the crank assembly 110. This allows for a degree of self-alignment between the way shafts 101, 102 and the roller wheel 112, creating smoother operating co-operation therebetween.

The way shafts 101, 102 illustrated are preferably machined from a high tensile strength steel alloy cylindrical bar stock, such as SAE 4340 alloy steel. As best seen in FIGS. 2-6, each way surface 101*a*, 102 is machined as a smooth planar surfaces on one side of the bar stock, and a reduced diameter cylindrical bearing stub portion 103 is machined to project from each opposite end, centered on the axis of symmetry "F". After machining, the way shafts 101, 102 are preferably heat treated to 39-41 Rockwell C through hardness.

Each of the bearing stub portions 103 in FIGS. 2-6 is installed and supported for rotation in the close fitting axial bore of a respective bearing mounting block 105. Each of the bearing mounting blocks 105 is respectively held against movement between the plates 92*a*, 92*b* of the yoke assembly 90 with the assistance of a transverse mounting pin 106, which mounting pin is itself held fast adjacent each of its free ends within in aligned mounting apertures 107 formed in each of the opposed plates 92*a*, 92 of the yoke assembly 90.

In operation, energizing the drive motor 108 causes rotation of the keyed output shaft 127 of the gear reduction unit 122, which in turn causes rotation of the flywheel 126 about the rotational axis "B". This rotation of the flywheel 126 causes the hardened steel outer circumference 114 of the roller wheel 112 rotatably mounted thereon to translate back and forth within the race 100, which composite motion urges the yoke assembly 90 to reciprocatingly roll, by means of the contoured bearing shaft rollers 94 in rolling contact with the first 71 and second 72 column bearing shafts, along the first 71 and second 72 column bearing shafts to thereby impart the reciprocating movement of the yoke assembly 90 in a direction substantially parallel to the longitudinal axis "A" to the mixing shaft 84 attached to the yoke assembly 90 adjacent the upper end 84*a* of the mixing shaft and, ultimately, to the mixing head attached adjacent to the lower end 84*b* of the mixing shaft 84, thereby to mix the fluids 28 in the vessel 21.

FIGS. 7-14 relate to a second embodiment of an improved reciprocating drive assembly 42 for use with a linear motion mixer according to the present invention. The reference numbers used for the first embodiment illustrated in FIGS. 1 to 6 have, for the most part, been carried over to FIGS. 7-14 to describe corresponding parts and assemblies of the second embodiment. Moreover, the same reference letters used to denote the various axes shown in FIGS. 1-6 have also been used in FIG. 7. Additional reference numbers have been added, where necessary.

The differences between the first embodiment illustrated in FIGS. 1-7 and the second embodiment illustrated in FIGS. 7-14 relate primarily to differences in the manner of construction of the yoke assembly 90, which differences optimize the reciprocating drive assembly 42 for lower cost production and ease of in-use assembly and repair. The first and second embodiments illustrated in FIGS. 1-14 are otherwise substantially the same in all material respects, as will be readily appreciated by an average person skilled in the art. Accordingly, only significant differences between the two embodiments will now be described.

Turning to these differences, it will be noted that the two plates 92*a*, 92*b* that make up the body 92 of the yoke assembly of the first embodiment have been replaced by two yoke bulkhead weldments 9 and 9. The top 10 and bottom 11 way shafts (which are constructed from the same materials and in the same general manner as the way shafts 101 and 102 of the first embodiment), are each preferably journalled for rotation in the bulkhead weldments 9, 9 about their respective axis of symmetry "F" by means of the reduced diameter cylindrical bearing stub portion 103 projecting from opposite ends of the way shafts 101 and 102. The bottom surface 101*a* of the top way shaft 101 and the top surface 102*a* of the bottom way shaft 102 are machined flat and are also preferably heat treated after machining to a 39-41 Rockwell C through hardness, in the same general manner as the way shafts 101 and 102 of the first embodiment.

Four way shaft collars 901 may optionally be fitted around the end portions of each of the top 101 and bottom 102 way shafts for added support of the way shafts 101, 102 and these collars 901 may optionally be welded to the bulkhead weldments 9, adjacent their laterally outer extents for extra rigidity, while still allowing for the way shafts 101, 102 to rotate within the cylindrical central bore of the collars. Alternatively, one, or both, of the collars 901 may also be optionally welded adjacent their laterally inner edges to the surface of the way shaft(s) 101 or 102, if it is desired that a way shaft(s) should not be allowed to rotate around its respective axis of symmetry "E".

Figure 10:
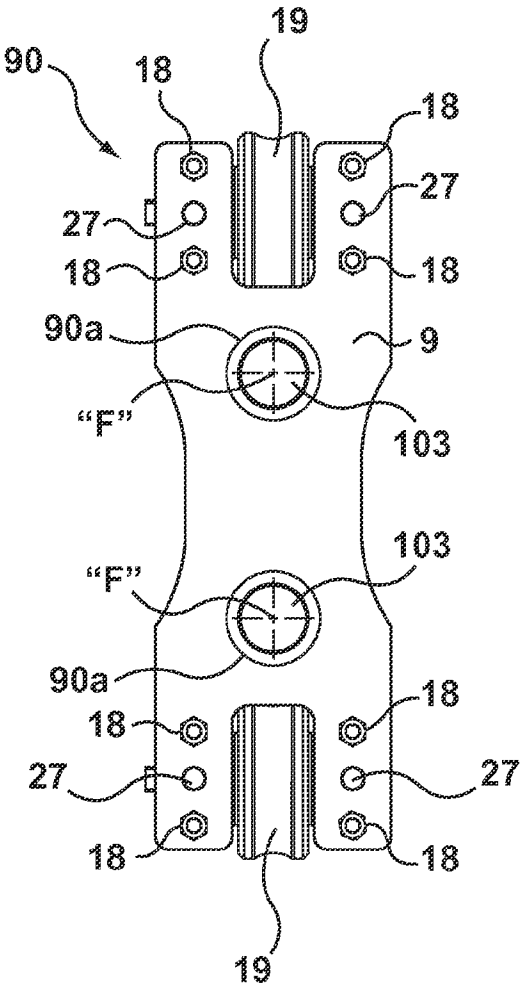
FIG. 10 is a top right side elevational view of the yoke assembly of FIG. 9.
Figure 9:
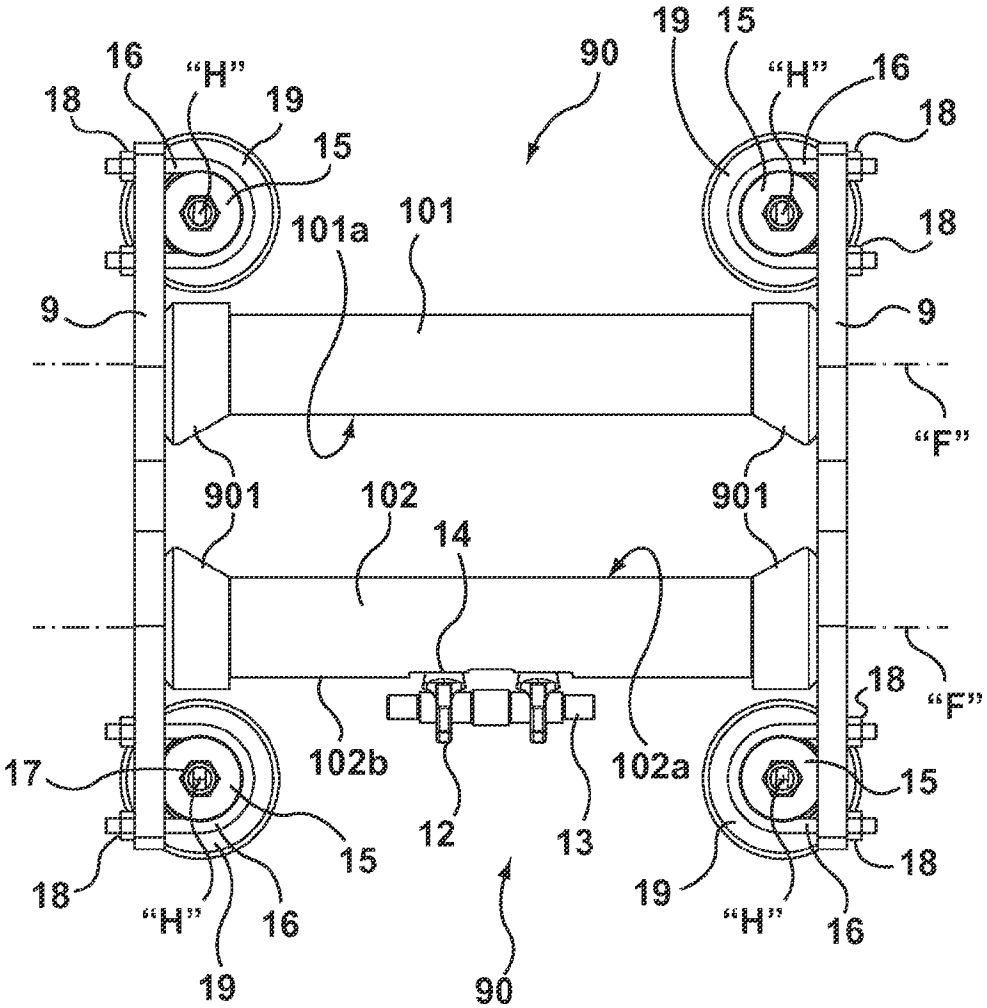
FIG. 9 is an enlarged scale front elevational view, in isolation, of the yoke assembly of FIG. 8.
Figure 11:
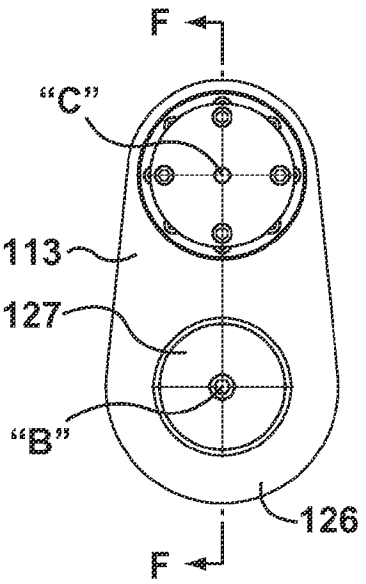
FIG. 11 is an enlarged scale front elevational view, in isolation, of the crank assembly of FIG. 8.
Figure 12:
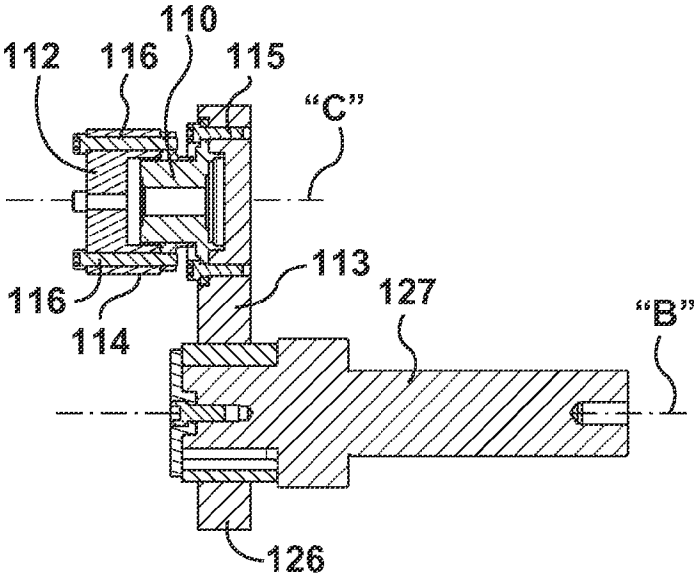
FIG. 12 is a medial sectional view, of the crank assembly of FIG. 11.
Figure 13:
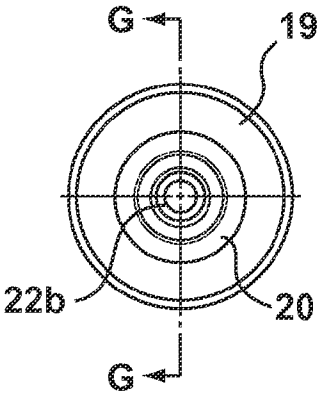
FIG. 13 is an enlarged scale front elevational view, in isolation, of one of the 4 shaft rollers shown in FIG. 8; and, FIG. 14 is a medial sectional view of the shaft roller of FIG. 13.
Figure 14:
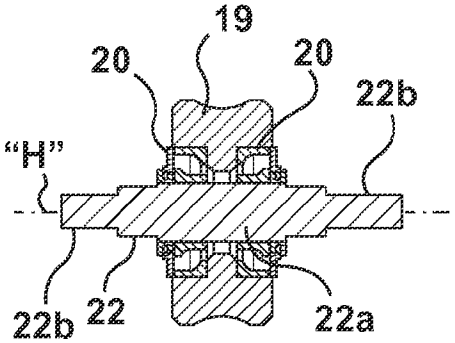

The way shaft collars 901 may be constructed from a different metal material than used to construct the bulkhead weldments 9, 9, and may be machined to each have a cylindrical end boss 90*a*, which cylindrical boss may itself be positioned within the bulkhead weldments 9, 9 as the journal bearing in which the respective one of the reduced diameter cylindrical bearing stub portions 103 is journalled for the aforementioned rotation of the way shafts 101, 102 which arrangement is visible in FIG. 10.

In the second embodiment of the invention shown in FIGS. 7-14, the mixing shaft 84 is connected to the yoke assembly 90 through a CREAC 29 by way of a rod eye 28 having a closed loop at its upper end, and is affixed at its lower straight end to the CREAC. A drive connector (clevis) pin 13 selectively engages said closed loop of the rod eye 28 between two lifting eye bolts 12 rigidly affixed to, and depending downwardly from, the bottom surface 102*b* of the lower way shaft 102.

In the second embodiment of the invention shown in FIGS. 7-14, the bearing shaft rollers 19 are mounted on the yoke assembly 90 in a different manner than in the first embodiment of FIGS. 1-6. More particularly, a central shaft 22, having a central axis "H" (best seen in FIGS. 13 and 14), is associated with each contoured shaft roller 19. The central shaft 22 constitutes a hub that has a central portion 22*a*, which portion is machined eccentrically with respect to the central axis of the shaft 22, and two free end portions 22*b*, 22*b* which are machined concentrically with respect to said axis "H". The central portion 22*a* supports the bearing shaft roller 19 for rotation about the axle shaft 22 via angular ball bearings 20,20. The free ends 22*b*, 22*b* of the axle shaft 22 are held against rotation in aligned lateral sockets formed in roller support member 15, which roller support member is in turn affixed to a respective one of the bulkhead weldments 9 by means of a U-bolt 16 surrounding the roller support member, with the free threaded ends of the U-bolts secured to the bulkhead weldment 9 by hex nuts 18, 18. With this arrangement, the radial distance between the central axis "H" and the respective guide axis "D" or "E" is selectively variable, so as to provide for adjustable positioning of each bearing shaft roller 19 relative to the respective column bearing shaft 71, 72 with which the roller 19 makes said rolling contact. In this manner, the eccentric machining of the central portion 22*a* allows each bearing shaft roller 19 to be adjustably positioned by rotation of the axle shaft 22 (before tightening of the U-bolts) as required to provide for proper (i.e., closely toleranced) rolling contact with the bearing shafts 71, 72.

Each contoured shaft roller 19 operatively protrudes through a respective U-shaped cut-out positioned adjacent each longitudinal end of the bulkhead weldment 9, so as to allow for rolling contact of the shaft roller 14 with the yoke assembly 90 along the column bearing shafts in substantially parallel relation to the guide axes "D" and "E". A roller guide pin 27 protruding from the base of each roller support member 15 is engaged by a corresponding positioning aperture formed in the bulkhead weldment 9 between the opposed hex nuts 18, 18 in order to easily locate and further stabilize the positioning of the roller support member 15 on the bulkhead weldment 9.

The second embodiment of the invention shown in FIGS. 7-14 preferably has two shaft support bolts 24 associated with each columnar bearing shaft 71,72, instead of only one, as shown in the first embodiment. These operate in substantially the same manner in each embodiment, with substantially the same effect and benefit.

The overall operation of a linear motion mixer built according to the second embodiment shown in FIGS. 7-14 is substantially the same as with the first embodiment shown in FIGS. 1-6.

From the above description, it will be seen that a further advantage of a linear motion mixer constructed with free-standing column bearing shafts as disclosed herein, is that it provides greater design flexibility over prior art designs utilizing linear bearings of non-circular cross-section, in that the longitudinal axis "A", the pair of guide axes "D" and "E", and the axis of symmetry "F" of the upper 101 and lower 102 way shafts along which the roller wheel 112 travels may now all be positioned in a substantially common vertical plane. Alignment of these axes in a common plane reduces the magnitude of unbalanced bending loads (i.e., moments of inertia) caused by misalignment of the mixing shaft 84 and the other drive components of the reciprocating drive assembly 42 that would otherwise be generated in scotch yoke designs where these axes are not aligned in the same vertical plane. As a consequence, frictional losses, uneven wear, and the possibility of binding or racking of the various components caused by such bending loads are significantly minimized over prior art linear motion mixers, which results in reduced energy consumption, maintenance and increases the longevity of the reciprocating drive assembly disclosed and claimed herein over prior art reciprocating drive assembly suitable for use in linear motion mixers.

Substituting contoured bearing shaft rollers having internal ball bearing assemblies for the close fitting linear slide bearings used in prior art linear motion mixers also significantly reduces the amount of energy lost as heat in the reciprocating drive assembly driving the mixing head, as rolling friction is substituted for sliding friction. Moreover, the improved design disclosed significantly increases energy transfer efficiency (from rotary motion of the flywheel to reciprocating motion of the mixer shaft), and provides for longer service intervals. The reduction of friction is significant enough that continuous oil lubrication of the column bearing shafts is no longer necessary. Also, the improved mechanism is, by reason of the open contoured contact face of the bearing shaft rollers, much more tolerant than the enclosed shaft bearings used in the prior art to wear of the bearing shafts and rollers, and to binding or racking of the yoke assembly with the vertically disposed bearing shafts caused by eccentric loading of the yoke assembly as is caused by, for example, misalignment of the drive shaft, improper assembly of the reciprocating drive assembly components, or rotation of the mixing shaft during reciprocation of the mixing head.

Also, the use of a low friction, heavy duty bearing hub having a roller wheel with an outer circumference formed from a hardened steel alloy material in rolling contact with upper and lower way surfaces formed of hardened steel alloy material also greatly reduces frictional losses in the reciprocating drive assembly, and reduces wear thereof over prior art reciprocating drive assemblies, all without the prior art need for substantially continuous lubrication of the interfaces of these contacting surfaces.

The use of one or more way shafts mounted on the yoke assembly so as to rotate about their axis of symmetry in operative response to contact by the roller wheel also greatly improves the reciprocating drive assembly of the applicant's linear motion mixer by providing for new levels of manufacture and assembly tolerances in the reciprocating drive assembly, which, in turn, increases its energy efficiency and reduces its ongoing maintenance requirements.

The use of an automotive wheel bearing hub as part of the crank assembly not only significantly reduces the cost of the reciprocating drive assembly herein disclosed over the custom machined bearing hubs used in the prior art, but also significantly decreases maintenance issues associated with such prior art bearing hubs by significantly reducing the meantime to failure of the crank assembly.

The introduction of a CREAC into the reciprocating drive assembly of a linear motion mixer as described hereinabove provides for significantly improved tolerance to tortional loading of the yoke assembly. This is so because, as the mixing disc is cycled up and down through the fluid to be mixed, it may spin, causing the mixing shaft to rotate with it around vertical axis "A". In the absence of a CREAC as described, such tortional loading can only be resisted by the yoke assembly. This puts undue loading on the bearing shaft rollers riding the vertically disposed bearing shafts, which undue loading acts as a restraint to reciprocal motion, thereby causing, as a minimum, significant lost energy and additional wear and servicing of the affected components. In extreme cases in the prior art, severe binding or racking of the yoke assembly as it reciprocates vertically along the bearing shafts is possible. The introduction of a CREAC into the Applicant's improved reciprocating drive assembly downstream of the yoke member and upstream of the mixing head prevents such undue tortional loading from being transmitted from the mixing head to the yoke member, thereby substantially reducing the referenced operational and maintenance problems that might otherwise arise.

Similarly, the introduction of a CREAC into a reciprocating drive assembly of a linear motion mixer as described hereinabove also provides significant accommodation for misalignment of the mixing shaft with its longitudinal axis "A", which misalignment may occur during manufacturing, assembly or operation of such mixer. Such misalignment can cause unbalanced shear loading on the yoke member and the bearing shaft rollers riding the vertically disposed bearing shafts, which unbalanced shear loading acts, in a similar manner as the tortional loading of the yoke member discussed in the previous paragraph, as a restraint to reciprocal motion, thereby causing, as a minimum, significant lost energy and additional wear and servicing of the affected components, and, in extreme cases, severe binding and/or racking of the yoke assembly as it reciprocates vertically along the bearing shafts. The introduction of a CREAC into a reciprocating drive assembly downstream of the yoke member and upstream of the mixing shaft prevents such unbalanced shear loading from being transmitted from the mixing shaft to the yoke member and other upstream components of the reciprocating drive assembly, thereby substantially reducing the operational and maintenance problems that would otherwise arise.

The rotational mounting of the upper and lower way shafts on the yoke assembly allows the way shafts to rotate about their respective axis of symmetry "F" (particularly the top way shaft), which rotation, in turn, allows the way shafts to accommodate misalignment of the roller wheel with the way shafts while, still translating the vertical motion of the crank member efficiently to the yoke member without lost energy or excessive wear or binding caused by such misalignment.

Other variations are within the spirit of the present invention. Thus, while the invention is susceptible to various modifications and alternative constructions without departing from the spirit of the inventions disclosed and claimed, only a limited number of embodiments thereof have been illustrated in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as", or, "for example") provided herein, is intended merely to better illuminate embodiments of the invention and does not pose a limitation on the scope of the invention unless otherwise claimed. No language in the specification should be construed as indicating any non-claimed element as essential to the practice of the invention.

Currently preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A linear motion mixer for mixing fluids within a vessel, the mixer comprising:

a mixing shaft having an upper and a lower end and defining a longitudinal axis extending therebetween, with the mixing shaft supporting a mixing head adjacent its lower end for immersion in said fluids;

a reciprocating drive assembly connectable to the mixing shaft adjacent its upper end for imparting reciprocating movement to the mixing head in substantially parallel relation to said longitudinal axis, wherein, said drive assembly comprises;

a flywheel mounted for rotation about a rotational axis extending substantially normal to said longitudinal axis;

a crank assembly projecting from the flywheel in a direction substantially parallel to the rotational axis;

first and second column bearing shafts each extending substantially parallel to the longitudinal axis in laterally spaced relation from each other so as to define a pair of guide axes substantially parallel to the longitudinal axis;

a yoke assembly positioned between the first and second column bearing shafts and having two or more contoured bearing shaft rollers mounted thereon for respective rolling contact with each of the first and second column bearing shafts so as to provide for rolling movement of the yoke assembly along said column bearing shafts in substantially parallel relation to said guide axes;

the yoke assembly having a linear race defined between a lower surface of an upper way shaft and an upper surface of a lower way shaft arranged in opposed relation to each other for operative contact by the crank assembly, the race being disposed within the yoke assembly with each said upper and lower surface being oriented substantially normal to both the rotational axis and the longitudinal axis;

said mixing shaft being connected to the yoke assembly adjacent its upper end for movement with the yoke assembly;

wherein, when the flywheel is rotated, the crank assembly is caused to linearly translate back and forth within the race, thereby urging the yoke assembly to reciprocatingly roll along the first and second column bearing shafts to impart said reciprocating movement to the mixing head.

2. A linear motion mixer according to claim 1, having four contoured bearing shaft rollers operatively mounted two each adjacent opposed sides of the yoke assembly for rolling contact with a respective one of the first and second column bearing shafts.

3. A linear motion mixer according to claim 2, wherein each of the contoured bearing shaft rollers are mounted for rotation on the yoke assembly by means of a hub member having a central axis, which hub member incorporates one or more ball bearing assemblies.

4. A linear motion mixer according to claim 3, wherein each of said ball bearing assemblies is a zero maintenance angular contact ball bearing assembly.

5. A linear motion mixer according to claim 4, wherein the radial distance between said central axis and the respective guide axis is selectively variable, so as to provide for adjustable positioning of each bearing shaft roller relative to the respective column bearing shaft with which it makes said rolling contact.

6. A linear motion mixer according to claim 5, wherein at least one of the way shafts is mounted on the yoke assembly to rotate about its axis of symmetry in response to said operative contact by the crank assembly.

7. A linear motion mixer according to claim 6, wherein both the upper and the lower way shafts are mounted on the yoke assembly to freely rotate about their respective axis of symmetry in response to operative contact by the crank assembly.

8. A linear motion mixer according to claim 7, wherein at least one of the upper and lower surfaces is formed from a heat hardened steel alloy material.

9. A linear motion mixer according to claim 8, wherein both the upper and lower surfaces are formed from a heat hardened steel alloy material.

10. A linear motion mixer according to claim 1, wherein the crank assembly comprises a low friction, heavy duty bearing hub.

11. A linear motion mixer according to claim 10, wherein the low friction, heavy duty bearing hub is an automotive wheel bearing hub.

12. A linear motion mixer according to claim 11, wherein the automotive wheel bearing hub is a commercially available truck wheel bearing hub.

13. A linear motion mixer according to claim 12, wherein a roller wheel having a hardened metal outer circumference is operatively mounted on the automotive wheel bearing hub for rolling contact of said circumference with the upper and lower way surfaces to affect said operative contact therewith by the crank assembly.

14. A linear motion mixer according to claim 1, wherein the mixing shaft is connected to the yoke assembly through a cylinder rod end alignment coupler (CREAC) interposed between the yoke assembly and the upper end of the mixing shaft.

15. A linear motion mixer according to claim 1, wherein the longitudinal axis, the pair of guide axes, and the axis of symmetry of the upper and lower way shafts are all positioned in a common substantially vertical plane.

* * * * *